FIG. 1
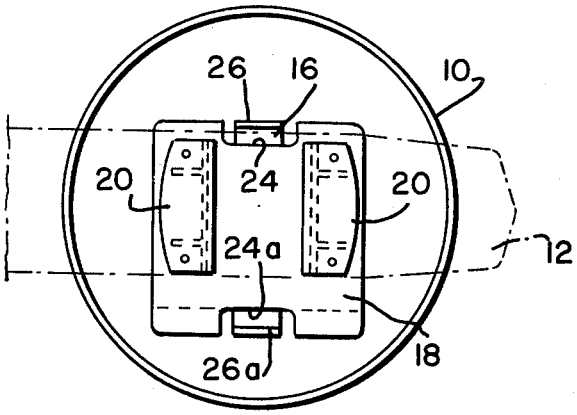
FIG. 2
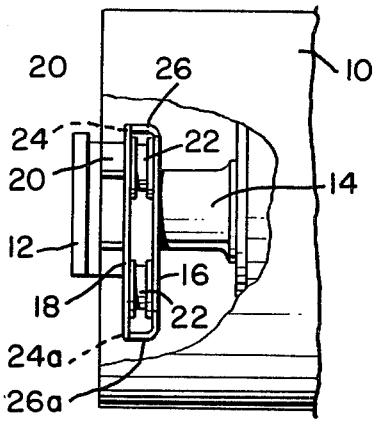
FIG. 7
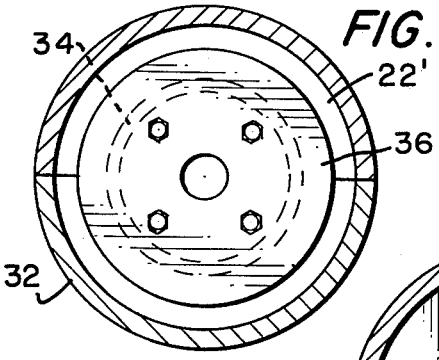
FIG. 8
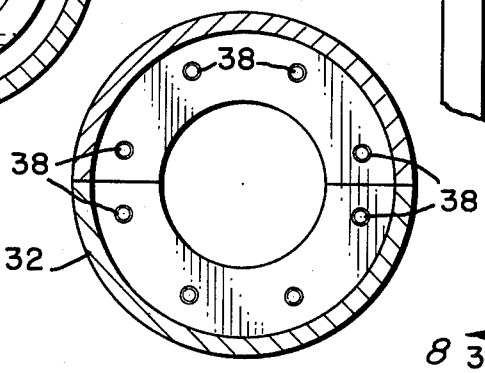
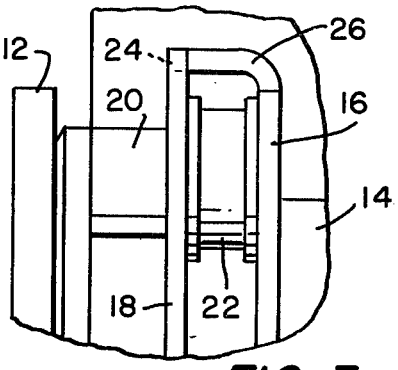
FIG. 3
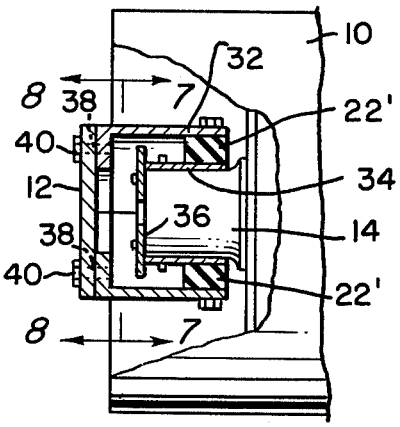
FIG. 6
FIG. 4
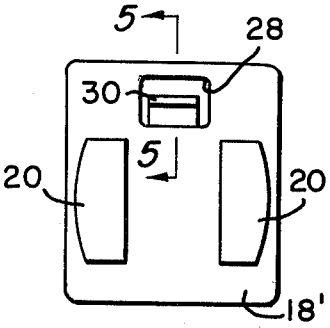
FIG. 5
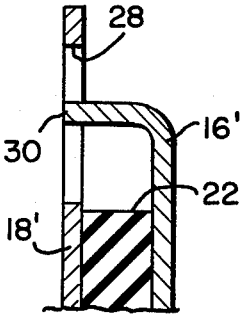

United States Patent [19]

Goehler

[11] 4,269,536

[45] May 26, 1981

[54] SHOCK ISOLATION MEANS FOR AN EARTH COMPACTOR DRUM

[75] Inventor: Robert F. Goehler, Greencastle, Pa.

[73] Assignee: Ingersoll-Rand Company, Woodcliff Lake, N.J.

[21] Appl. No.: 95,638

[22] Filed: Nov. 19, 1979

[51] Int. Cl.[3] ..... E01C 19/38

[52] U.S. Cl. ..... 404/117; 180/20; 172/184

[58] Field of Search ..... 404/117, 103; 180/20; 172/184

[56] References Cited

U.S. PATENT DOCUMENTS

| | | | |
|---|---|---|---|
| 2,671,386 | 3/1954 | Kerridge | 404/117 |
| 3,026,781 | 3/1962 | Schafer | 404/117 |
| 3,108,519 | 10/1963 | Domenighetti | 404/117 |
| 3,195,429 | 7/1965 | Cowley | 404/117 |
| 3,437,019 | 4/1969 | Peterson | 404/117 |
| 3,623,407 | 11/1971 | Dresher | 404/117 |
| 3,778,177 | 11/1973 | Haker | 404/117 |
| 3,897,165 | 7/1975 | Vural | 404/117 |
| 3,966,344 | 6/1976 | Haker | 404/117 |

*Primary Examiner*—Nile C. Byers, Jr.
*Attorney, Agent, or Firm*—Bernard J. Murphy

[57] ABSTRACT

In a preferred embodiment of the invention a pair of shock plates are disposed in parallel, and substantially bi-planar, coupled together by elastomeric elements. One of the shock plates has a cut-out therein and the other has a limb extending into the cut-out and spaced apart from the sides thereof. The one shock plate is mounted to the drum bearing housing of the earth compactor, and the other shock plate is mounted to the frame. Accordingly, upon the drum being vibrated, or shocked, or otherwise displaced, the limb engages one or more sides of the cut-out, and the movement between the plates is thereby limited to a given distance, in order that the elastomeric coupling will not be unduly stretched, destroyed, or fatigued too early.

11 Claims, 8 Drawing Figures

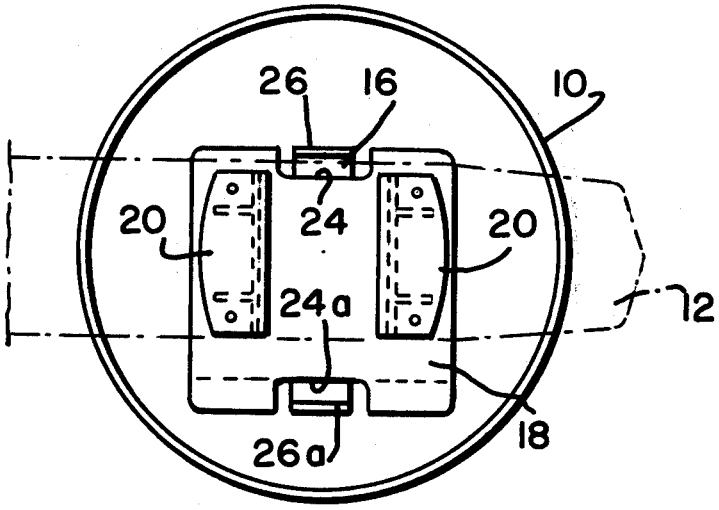

SHOCK ISOLATION MEANS FOR AN EARTH COMPACTOR DRUM

This invention pertains to vibratory earth compactors of the rolling-drum type, and in particular to means for isolating drum vibrations from the compactor frame.

The vibratory drum of a drum compactor must be shock-isolated from the operator (i.e., from the operator-bearing frame) during use. This is done by means of an elastomeric coupling between the drum and compactor frame, and an exemplary embodiment of this is disclosed in U.S. Pat. No. 3,623,407, issued to Seymour Dresher, dated Nov. 30, 1971, for a Vibratory Compaction Roller.

In moderate use for earth compaction, the vibratory drum will ordinarily not stress the elastomeric coupling unduly. However, as the drum encounters a large ground obstacle, or during shipment and the like when the machine is subject to hoisting, being dropped, or off-loaded from a truck or railroad car carelessly, it is possible for the drum to become considerably displaced (relative to the frame) so that the elastomeric coupling material is elongated and fatigued or even torn. What has been needed, then, is some simple, inexpensive, and efficient means to limit the amount of displacement wich may be permitted to occur between the frame and drum. It is an object of this invention to set forth such long-sought means.

It is particularly an object of this invention to set forth an improved shock isolation means, for an earth compactor drum, comprising a first shock-plate, for mounting thereof to an earth compactor drum frame; a second shock-plate, for fixed mounting thereof to a bearing housing of an earth compactor drum; and elastomeric means coupling said shock-plates together for relative, resilient, shock-isolating movement therebetween; wherein the improvement comprises limit stop means carried by at least one of said shock plates, spaced apart from an adjacent surface of the other of said shock-plates, for contacting engagement of said limit stop means with said surface to limit shock-isolating movement between said plates to a given distance.

It is also an object of this invention to set forth an improved shock isolation means, for an earth compactor having first means comprising a frame, and second means comprising a drum and a bearing housing therefor, comprising a shock-plate for mounting thereof to one of said first and second means; limit stop means for mounting thereof to the other of said first and second means; and elastomeric means coupling said shock-plates and said limit stop means together in spaced-apart adjacency for: (1) relative, resilient, shock-isolating movement therebetween, and (2)for mutual, contacting engagement of said shock plate and limit stop means, to limit shock-isolating movement therebetween to a given distance.

Further objects of this invention, as well as the novel features thereof, will become more apparent by reference to the following description, taken in conjunction with the accompanying figures, in which:

FIG. 1 is a side, elevational view of a compactor frame and drum arrangement, incorporating the invention, the frame being shown only in phantom for reference purposes;

FIG. 2 is a cut-away frontal view, the same having been taken from the right-hand side of FIG. 1;

FIG. 3 is an enlarged detail of a portion of FIG. 2;

FIGS. 4 and 5 are illustrations of an alternative embodiment of the invention; FIG. 4 is a side, elevational view, and FIG. 5 is a cross-sectional view taken along section 5—5 of FIG. 4, but in an enlarged scale over that of FIG. 4;

FIG. 6 is a cut-away and partially cross-sectioned view, similar to that of FIG. 2, of yet a further alternative embodiment of the invention;

FIG. 7 is a cross-sectional view taken along section 7—7 of FIG. 6; and FIG. 8 is a cross-sectional view taken along section 8—8 of FIG. 6. The scale of both FIGS. 7 and 8 is enlarged over that of FIG. 6.

As shown in the figures, an earth compactor drum 10 is rotatably mounted to a frame 12 (which is shown only in phantom in FIG. 1). A drum bearing housing 14 is axially fixed within the drum 10, and thereto is mounted a first shock-plate 16. A second shock-plate 18 is mounted to the frame, in parallel to the first shock-plate 16, by means of brackets 20. A plurality of elastomeric elements 22 couple the two plates 16 and 18 together by means of bolts (not shown) in the manner disclosed in the aforesaid U.S. Pat. No. 3,623,407. Accordingly, vibrations and/or displacements induced in the drum 10 will not be transmitted to the frame 12.

As seen in FIG. 1, the second shock-plate 18 has opposed cut-outs 24 and **24*a* formed therein. Fingers 26 and 26*a* projecting from the first shock-plate 16, intrude into the cut-outs, but are spaced apart from the surfaces of the cut-outs approximately two inches (50.80 mm.). Now, should the plates 16 and 18 proceed to exhibit relative vertical, horizontal, or rotary movement therebetween of more than the cited spacing, the fingers 26 and 26*a* and the surfaces of the cut-outs 24 and 24*a* will come into contact and prohibit further displacement between the frame 12 and the drum 10. Hence, the fingers 26 and 26*a*** serve as limit-stops to control the displacement.

The optimum spacing, between the fingers 26 and **26*a* and the surfaces of the cut-outs 24 and 24*a* is given as approximately two inches (50.80 mm.). However, this may be varied, depending upon related parameters, such as: the number of coupling elements 22, their modulus of elasticity, the relative weight of the drum 10, etc. Accordingly, such spacing may range from one inch (25.40 mm.) to three inches (76.20 mm.). Also, it may be found desirable, in given circumstances, to limit spacing between fingers 26*a* and cut-outs 24*a* (i.e. at each axial end of the drum 10) to one inch (25.40 mm.), and fingers 26 and cut-outs 24 to one and a half or two inches (38.10 mm. or 50.80 mm.). This would limit upward movement of the drum 10, relative to the frame 12, more severely than downward movement thereof. Also, the "fore" and "aft" spacing of the fingers 26 and 26*a*, relative to the cut-outs 24 and 24*a*** may be different—if and as desired. Very simply, the invention is not limited to uniform spacing; rather, it comprehends such spacing as will yield that limiting of movement in vertical, horizontal, and rotary planes or axes as is wished.

FIGS. 4 and 5 depict an alternative arrangement which functions quite like that of the embodiment illustrated in FIGS. 1 through 3, except that only one finger 30 is required. But one finger is necessary, in that the frame-mounted shock-plate 18' has a four-sided cut-out 28 formed therein.

Patently, the bearing housing-mounted shock plate 16', or at least the finger 30 thereof, must be of heavier gauge (or reinforced) as compared to the finers 26 and 26*a* of the first embodiment of the invention (FIGS. 1–3). The latter fingers somewhat share the loading (occasioned by excessive excursions between the drum 10 and the frame 12), whereas finger 30 must solely withstand such loading). Relative gauges of the fingers 30, and 26 and 26*a*, are not shown in the Figures. Rather, the illustrations are exemplary, only; they are not drawn to any given scale.

FIGS. 6 through 8 depict yet a further embodiment of the invention in which the means comprising the limit-stop is an annular shell 32 of two parts. The latter is bolted to an annular, elastomeric element 22' which, in turn, is secured to a sleeve 34 bolted to the bearing housing 14. The end of the bearing housing further has bolted thereto a single shock-plate 36. The plate 36 is encompassed by the limit-stop shell 32.

In this latter embodiment, the halves of shell 32 have integral studs 38, which are received in holes formed therefor in frame 12, and which receive nuts 40 (to secure the shell 32 to the frame).

While I have described my invention in connection with specific embodiments thereof, it is to be clearly understood that this is done only by way of example, and not as a limitation to the scope of my invention as set forth in the objects thereof and in the appended claims.

I claim:

1. An improved shock isolation means, for an earth compactor drum having an axis, comprising:

a first shock-plate, for mounting thereof to an earth compactor drum frame;

a second shock-plate, for mounting thereof to an earth compactor drum; and elastomeric means coupling said shock-plates together for relative, resilient, shock-isolating movement therebetween; wherein the improvement comprises:

limit stop means carried by at least one of said shock-plates, spaced apart from an adjacent surface of the other of said shock-plates, for contacting engagement of said limit stop means with said surface to limit shock-isolating movement, in vertical, horizontal, and rotary planes normal to the drum axis, between said plates.

2. An improved shock isolation means, according to claim 1, wherein:

said first and second shock-plates comprises substantially uniplanar elements;

said elastomeric means couples said plates together, a prescribed distance apart, in parallel, bi-planar disposition;

said other shock-plate has a plural-sided cut-out formed therein; and said limit stop means comprises a rigid limb extending from said one shock-plate, across and further than said prescribed distance, intrusively into said cut-out for contacting engagement thereof with sides of said cut-out.

3. An improved shock isolation means, according to claim 2, wherein:

said limb and sides of said cut-out are spaced apart not less than approximately one inch (25.40 mm.) no more than approximately three inches (76.20 mm.).

4. An improved shock isolation means, according to claim 2, wherein:

said cut-out comprises a generally "U" shaped channel.

5. An improved shock isolation means, according to claim 2, wherein:

said other shock-plate has a plurality of said cut-outs formed therein; and said one shock-plate has a plurality of said rigid limbs extending therefrom intrusively into said plurality of cut-outs, each of said limbs intruding into a respective one of said cut-outs.

6. An improved shock isolation means, according to claim 5, wherein:

said other shock-plate has a pair of oppositely disposed cut-outs formed therein; and said one shock-plate has a pair of said rigid limbs extending therefrom.

7. An improved shock isolation means, according to claim 6, wherein:

said pair of cut-outs comprises generally "U" shaped channels formed in opposite edges of said other shock-plate; and said pair of rigid limbs are disposed in parallel astride said other shock-plate.

8. An improved shock isolation means, for an earth compactor having first means comprising a frame, and second means comprising a drum having an axis, comprising:

a shock-plate for mounting thereof to one of said first and second means;

limit stop means for mounting thereof to the other of said first and second means; and elastomeric means coupling said shock-plates and said limit stop means together in spaced-apart adjacency for: (1) relative, resilient, shock-isolating movement therebetween, and (2) for mutual, contacting engagement of said shock plate and limit stop means, to limit shock-isolating movement, therebetween, in a plurality of planes normal to said drum axis.

9. An improved shock isolating means, according to claim 8, wherein said elastomeric means comprises an annular element.

10. An improved shock isolation means, according to claim 8, wherein:

said limit stop means comprises an annular shell in envelopment of said element.

11. An improved shock isolation means, according to claim 8, wherein:

said limit stop means and said shock plate are concentrically disposed.

* * * * *